US007628368B2

(12) United States Patent
Swannell et al.

(10) Patent No.: US 7,628,368 B2
(45) Date of Patent: Dec. 8, 2009

(54) INTERLOCKING ROLL SUPPORT AND SPACING STRUCTURE

(75) Inventors: Robert W. Swannell, Neenah, WI (US); David B. Rosten, Sinking Spring, PA (US)

(73) Assignee: Great Northern Corporation, Appleton, WI (US)

( * ) Notice: Subject to any disclaimer, the term of this patent is extended or adjusted under 35 U.S.C. 154(b) by 0 days.

(21) Appl. No.: 12/120,572

(22) Filed: May 14, 2008

(65) Prior Publication Data

US 2008/0210840 A1 Sep. 4, 2008

Related U.S. Application Data

(63) Continuation of application No. 11/215,832, filed on Aug. 30, 2005, now Pat. No. 7,434,777.

(51) Int. Cl.
*B65D 19/00* (2006.01)
*B65D 85/20* (2006.01)

(52) U.S. Cl. ..... 248/346.02; 248/68.1; 206/443; 206/391

(58) Field of Classification Search ..... 248/346.02, 248/671, 68.1; 108/51.11, 55.3, 57.29; 211/73, 211/59.4; 206/443, 446, 564, 394, 593, 391; 229/100; D9/456; D34/38
See application file for complete search history.

(56) References Cited

U.S. PATENT DOCUMENTS

| | | | | |
|---|---|---|---|---|
| 3,948,455 | A | 4/1976 | Schwartz | |
| 4,096,986 | A | 6/1978 | Florian | |
| 4,098,453 | A | 7/1978 | Arneson | |
| 4,428,306 | A | 1/1984 | Dresen et al. | |
| 4,442,991 | A | 4/1984 | Levens | |
| 5,435,447 | A | 7/1995 | Weatherford et al. | |
| 5,584,408 | A | 12/1996 | Orkisz | |
| 5,899,331 | A | 5/1999 | Warren, Jr. | |
| 5,934,467 | A | 8/1999 | Gilgert et al. | |
| 5,950,959 | A | 9/1999 | Milliorn | |
| 6,209,839 | B1 | 4/2001 | O'Malley | |
| 6,322,034 | B1 | 11/2001 | O'Malley | |
| 6,474,613 | B2 | 11/2002 | O'Malley | |
| 6,997,330 | B2 | 2/2006 | Pachao-Morbitzer et al. | |
| D518,720 | S | 4/2006 | Gratz | |
| 7,044,358 | B2 | 5/2006 | Gratz | |
| 7,434,777 | B2 * | 10/2008 | Swannell et al. | 248/346.02 |
| 2002/0063194 | A1 | 5/2002 | O'malley | |
| 2007/0045500 | A1 | 3/2007 | Swannell et al. | |

* cited by examiner

*Primary Examiner*—Anita M King
(74) *Attorney, Agent, or Firm*—Andrus, Sceales, Starke & Sawall, LLP

(57) ABSTRACT

A roll support and spacing member has parallel, connected and nestable first and second sections foldable upon a hinge to provide support structure in the middle of a stack of rolls. The roll support and spacing member has upwardly and downwardly facing, roll-engaging indentations with the sections being separable to provide top and bottom support pieces for engaging rolls in the stack. The sections are movable into superposed relationship with one another. The first and second sections have peripheral flanges located along opposed sides and opposed ends thereof and formed with cooperable interlocking structure positively retaining the sections together when the sections are placed in superposed relationship.

8 Claims, 6 Drawing Sheets

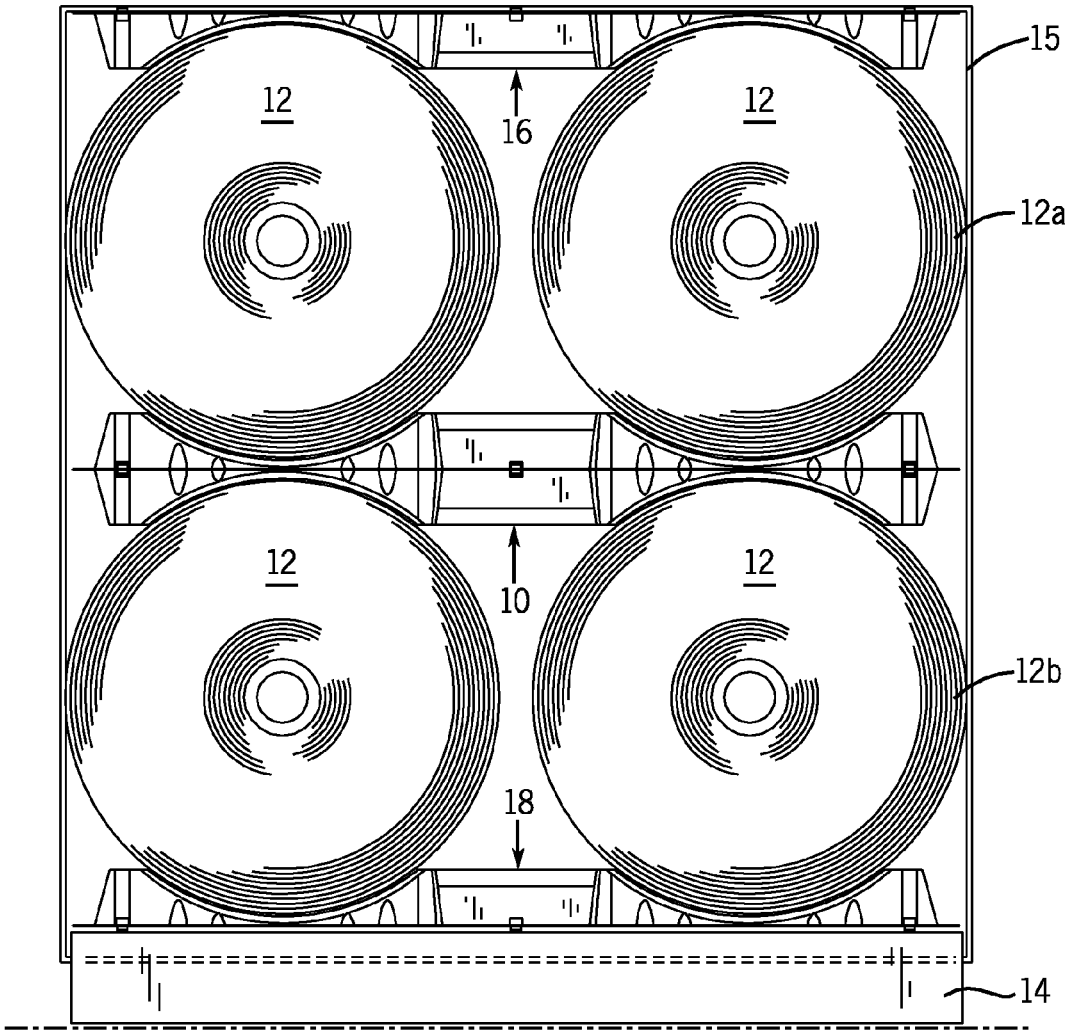
FIG. 1
FIG. 3A
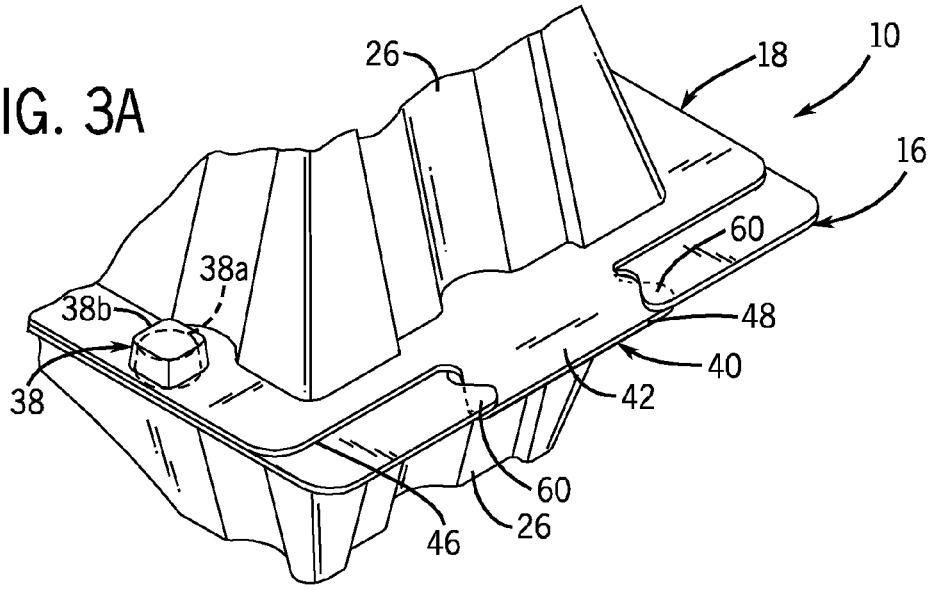

INTERLOCKING ROLL SUPPORT AND SPACING STRUCTURE

CROSS-REFERENCE TO RELATED APPLICATION

This application is a continuation application of application Ser. No. 11/215,832, filed on Aug. 30, 2005, now U.S. Pat. No. 7,434,777, of Robert W. Swannell and David R. Rosten for Interlocking Roll Support And Spacing Structure.

FIELD OF THE INVENTION

The present invention relates generally to the packaging of rolls of web material for shipping and the like. In particular, the invention pertains to an interlocking structure preferably made from thermoformed plastic for protectively supporting and spacing rolls of web material in a multi-layer stack.

BACKGROUND OF THE INVENTION

Heretofore, molded stack supports have been provided for rolls in a single two-roll support structure foldable along a seam or hinge into a superposed relationship to provide mid-stack support or clamshell sections with upwardly and downwardly extending, roll-engaging cradles or indentations with the supports being easily separable to provide top and bottom pieces for use in the formation of a stack. Such structure shown in U.S. Pat. No. 5,080,314 issued Jan. 14, 1992 to Moyer et al, U.S. Pat. No. 5,899,331 issued May 4, 1999 to Warren, Jr. and U.S. Pat. No. 5,934,467 issued Aug. 10, 1999 to Gilfert et al.

Roll supports of the type described above have traditionally been manufactured from polystyrene foam or molded pulp constructions that have some nesting capability for stacking the support during storage. However, there are problems encountered using polystyrene foam because it is brittle and has a minimum of structural flexibility. Additionally, foam supports do not offer the compact storage of unused supports. Molded pulp or paper-mache supports are sometimes inadequate for support of rolls in humid weather where they may disintegrate when it is moist. Subsequently, the molded pulp support requires special packaging protection. Like foam supports, their construction is not conducive to a compact stacking formation. When supporting particularly large sized and heavy rolls in a stack, it is desirable to consider a roll support material that is strong enough to support heavy weights, is weather resistant, and offers improved stackability.

Furthermore, it is important especially when providing mid-stack support between upper and lower rolls of large sized and substantial weight, to endure that the superposed sections are maintained together and held aligned so as to improve mid-stack roll stability. In addition, the superposed sections are maintained together to eliminate the requirement that loading operators must hold the supports in alignment during loading.

Accordingly, it is desirable to provide a differently configured structure for improving the support and spacing of rolls shipped in a multi-layer stack. It is also desirable to provide a more reliable roll support and spacing structure for enhancing mid-stack roll support. It remains desirable to provide a versatile roll support and spacing structure which can be conveniently manipulated to form support and spacing at various positions in a multi-layer stack.

SUMMARY OF THE INVENTION

It is one object of the present invention to provide a reconfigurable two roll support and spacing structure for supporting rolls throughout a multi-layer stack.

It is also an object of present invention to provide a roll support and spacing structure constructed of thermoformed plastic which offers increased strength and stacking characteristics.

It is another object of the present invention to provide a roll support and spacing structure having superposed sections which are selectively interlocked and aligned together for enhancing mid-stack support.

In one aspect of the invention, a roll support and spacing member has parallel, connected, nestable first and second sections foldable upon a hinge to provide support structure in the middle of a stack of rolls. The roll support and spacing member also has upwardly and downwardly facing roll-engaging indentations with the sections being separable to provide top and bottom support pieces for engaging rolls in the stack. The sections are movable into superposed relationship with one another. The invention is improved wherein the first and second sections have peripheral flanges along opposed sides and opposed ends thereof formed with cooperable, interlocking structure positively retaining the sections together when the sections are placed in superposed relationship.

In the preferred embodiment, the interlocking structure is formed as a tab and notch arrangement. The tab and notch arrangement is provided on the opposed ends of the sections. The tab and notch arrangement has winged portions frictionally engagable and in overlapping relationship with one another. Peripheral flanges are formed along their opposed sides with a plurality of engagable bosses for maintaining alignment between the sections when the sections are in superposed relationship. The bosses are located on opposed sides of the sections. Some of the bosses are round in cross section and other of the bosses are polygonal in cross section. The sections are constructed preferably from thermoformed plastic material. The roll-engaging indentations are provided with a slip-reducing material to prevent movement of the rolls thereon.

In another aspect of the invention, an arrangement is provided for supporting and stacking rolls of material in a multi-layer stack of multi-roll layers. Each layer includes pairs of rolls located in axial end-to-end orientation. The arrangement has roll support and spacing structure having first and second sections foldably interconnected along a hinge with each section having aligned roll-receiving indentations for receiving and supporting rolls so that upward facing indentations engage a bottom of an upper layer of rolls and downwardly facing indentations engage a top of a bottom layer of rolls. The sections are separable to provide top and bottom support pieces for engaging rolls in the stack. The sections are also movable into superposed relationship with one another. The sections have peripheral flanges along opposed sides and opposed ends thereof which flanges engage each other when the sections are in superposed relationship. The flanges are formed with cooperable interlocking tab and notch structure for positively retaining the sections locked together when in superposed relationship. The flanges are further are formed with a plurality of bosses which are engagable with one another when the sections are in superposed relationship to maintain alignment of the sections.

Various other objects, features and advantages of the invention will be made apparent in the following description taken together with the drawings.

BRIEF DESCRIPTION OF THE DRAWINGS

The drawings illustrate the best mode presently contemplated in carrying out the invention.

In the drawings:

FIG. 1 is an end view of a plastic roll support and spacing structure embodying a present invention as used in a multi-layer stack of rolled web material;

FIG. 3A is an enlarged perspective end view of the superposed sections interconnected together as taken on line 3A-3A of FIG. 3;

DETAILED DESCRIPTION OF THE INVENTION

Referring now to FIG. 1, a roll support and spacing structure 10 embodying the present invention is designed to support and space a plurality of generally similar diameter rolls 12 of web material on a storing and shipping support, such as a pallet 14. In the preferred embodiment, the rolls 12 have a relatively large diameter of 24", but it should be understood that the roll support and spacing structure 10 of the present invention could be used for rolls 12 of varying diameters and lengths.

The rolls 12 are typically arranged in a multi-layer stack. Axes of the rolls 12 extend horizontally and parallel to each other. The roll support and spacing structure 10 is positioned between an upper roll layer 12*a* and a lower roll layer 12*b*. As will be described below, portions of the roll support and spacing structure 10 are placed on the pallet 14 beneath the lower roll layer 12*b*, and also above the upper roll layer 12*a*. As is known, the stack can be secured to the pallet 14 by enclosing the pallet such as with a stretch film 15.

With reference to FIG. 2-6, roll support and spacing structure 10 is preferably fabricated in a generally rectangular shape, and thermoformed from a thin sheet of high impact PET or some other suitable plastic material. The sheets of plastic should have a thickness before thermoforming in the range of 30-50 mils. The thickness of the sheet has an effect on the strength of the end product, so the precise thickness should depend on the size of the expected load and the conditions made under which the load is expected to be shipped and stored. In the embodiment illustrated, the structure 10 is typically 48" in length, 14" in width and about 3" in height, but the sizing is not critical and the structure 10 may have other dimensions to suit the particular application.

Figures 2, 3, 4:
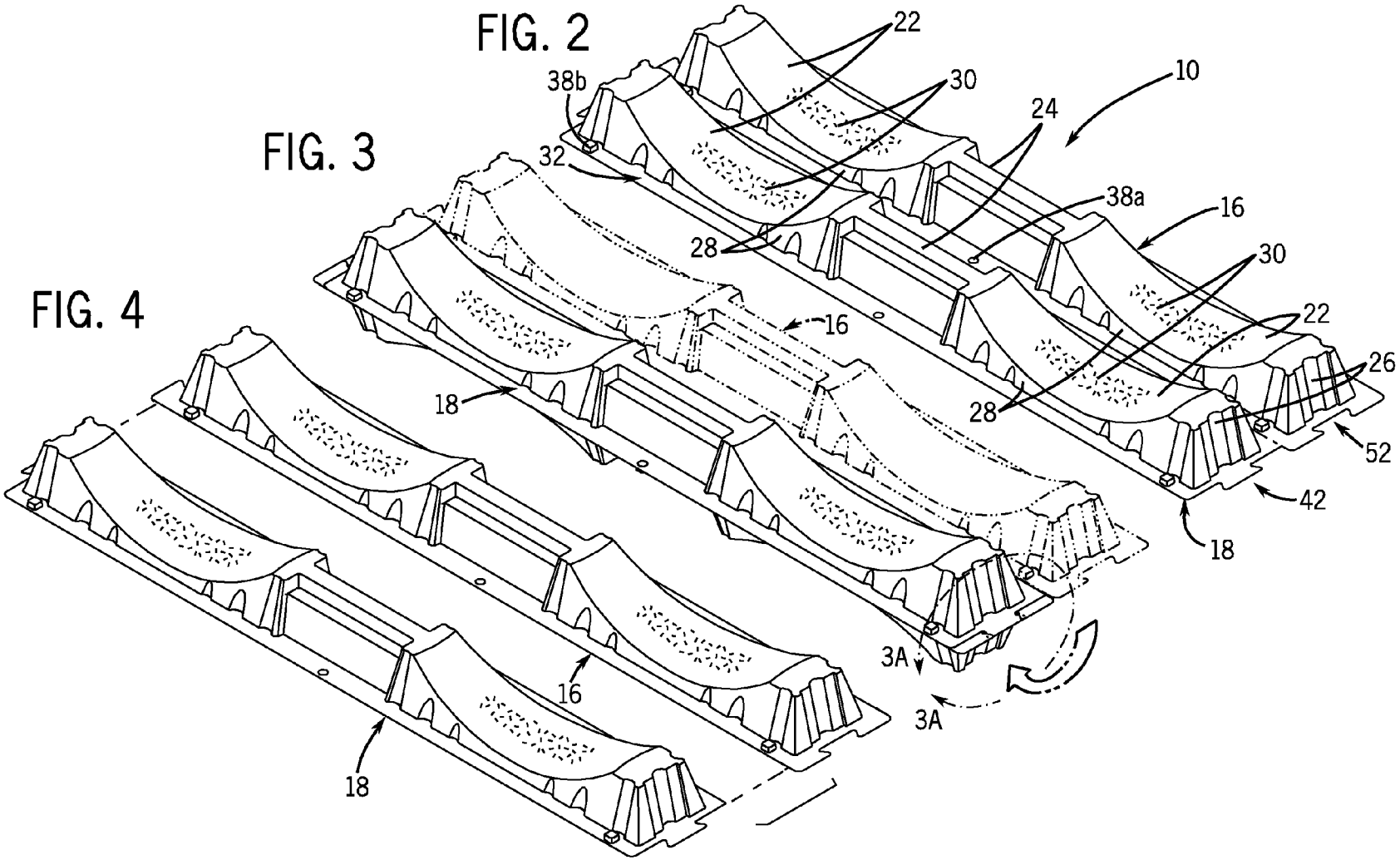
FIG. 2 is a perspective view of the roll support and spacing structure showing two sections hingedly connected together.
FIG. 3 is a perspective view showing one of the sections in FIG. 2 about to be folded beneath the other section in superposed relationship before being interconnected thereto.
FIG. 4 is a view of the two sections in FIG. 2 shown broken apart from their hinged connection.
Figure 5:
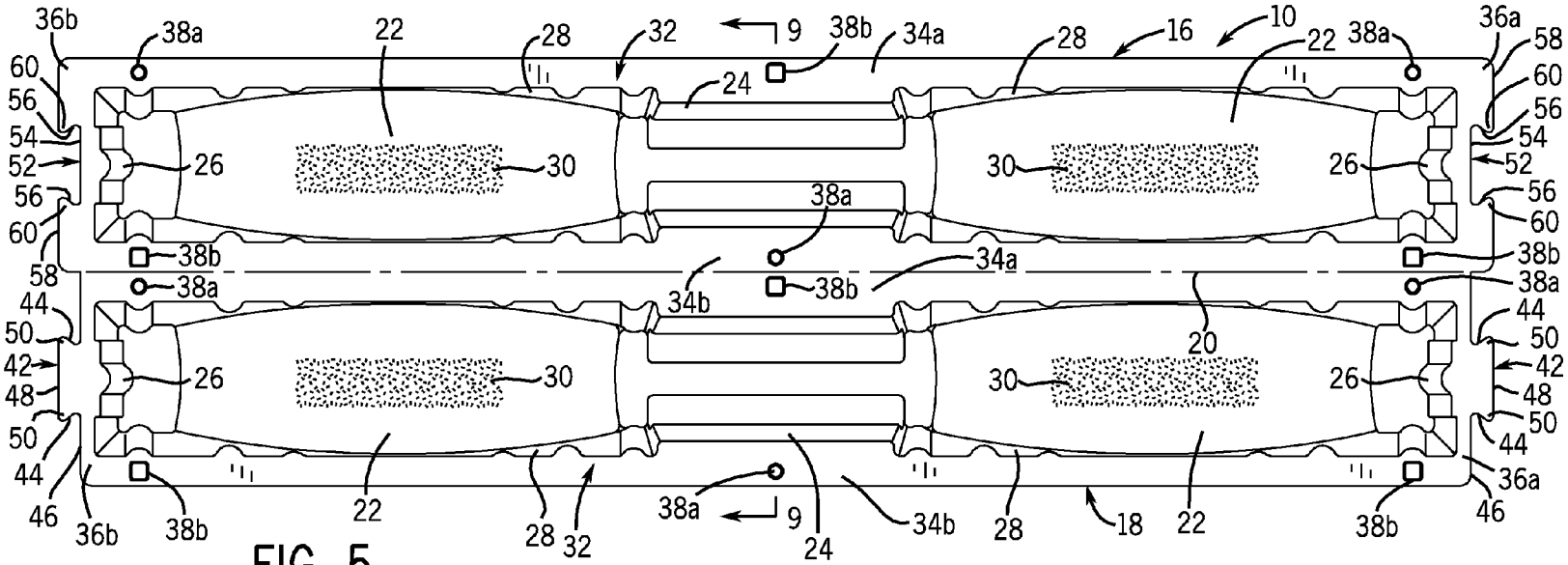
FIG. 5 is a top view of FIG. 2.

As seen in FIGS. 2 and 5, the structure 10 includes a first elongated section 16 and a second elongated section 18, each having adjacent longitudinal edges interconnected to each other along a frangible hinge 20 such that the sections 16, 18 may be easily pivoted relative to each other (FIG. 3) or separated along the hinge 20 (FIG. 4). When the sections 16, 18 are thermoformed, they are interconnected in side-by-side, parallel relation with each other being substantially similar in construction. Although not shown, it should be appreciated that the sections 16, 18 are nestable or stackable for transit or storage. An upper surface of each section 16, 18 includes a pair of spaced apart, semi-circular roll-engaging indentations 22, which are separated by a land 24 and are positioned between inwardly and upwardly sloping end walls 26. The indentations 22 have sidewalls 28 which extend between the land 24 and a respective end wall 26. The indentations 22 are concavely-shaped with a smooth surface throughout most of the surface area. When formed, the indentations 22 in first section 16 are in alignment with the indentations 22 in the second section 18. Because of the inherently slippery nature of the plastic, the indentations 22 are provided with a non-slip surface 30 along a portion of the concavity to prevent movement of the rolls 12 when they are in stacked formation. It is contemplated that the radius of the indentations 22 is greater than the depth of the indentations 22. With this design, the individual structures 10 do not engage each other when used to form a multi-layer stack.

Figure 9:
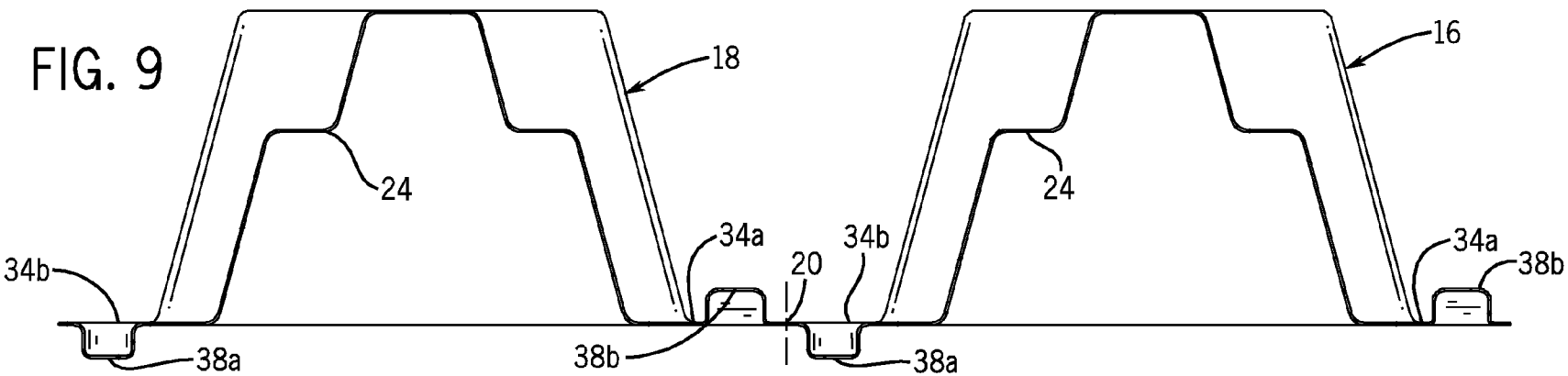
FIG. 9 is a sectional view taken on line 9-9 of FIG. 5.
Figure 12:
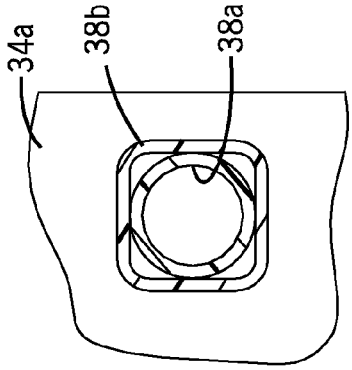
FIG. 12 is sectional view taken on line 12-12 of FIG. 8.
Figure 11:
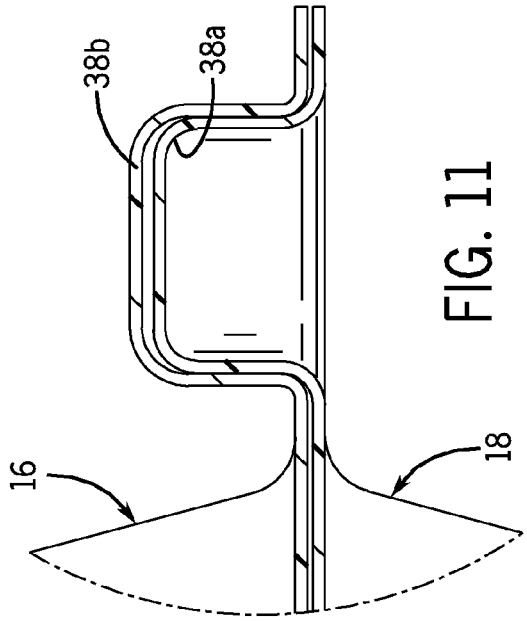
FIG. 11 is an enlarged detailed view of alignment structure taken on line 11-11 of FIG. 10.
Figure 10:
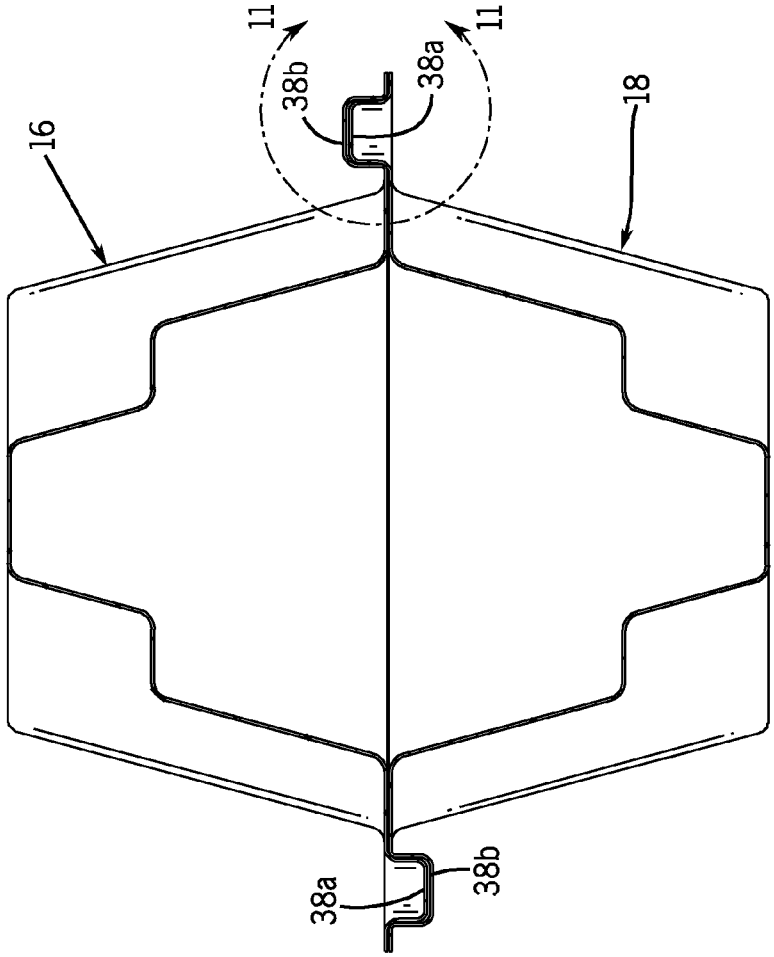
FIG. 10 is a sectional view taken on line 10-10 of FIG. 6.

Each section 16, 18 has a peripheral, planar flange 32 surrounding the land 24, the end walls 26 and the side walls 28. The flange 32 has opposed sides 34*a*, 34*b*, and opposed ends 36*a*, 36*b*. The sides 34*a*, 34*b* are formed with a plurality of protruding bosses 38 which are utilized to provide alignment between the sections 16, 18 when the sections 16, 18 are placed in superposed relationship with the underside of flanges 32 engaging each other as seen in FIG. 10. Some of the bosses 38*a* are formed with round cross sections, while other bosses 38*b* have polygonal or square cross sections which are configured to non-lockingly receive the round bosses 38*a* (FIGS. 3A, 7, 11, 12). As depicted in FIG. 9, certain of the bosses 38 protrude upwardly from the flanged sides 34*a*, 34*b* while other bosses 38 protrude downwardly from flanged sides 34*a*, 34*b*. The bosses 38 also help to maintain separation between the sections 16, 18 when they are nested together for storage or transit.

As a particular feature of the invention, the sections 16, 18 are provided on their opposed ends 36*a*, 36*b* with cooperable interlocking structure 40 (FIG. 3A) for positively connecting and retaining the sections 16, 18 together when they are placed in superposed relationship to each other such as when the sections 16, 18 are positioned between the upper roll layer 12*a* and the lower roll layer 12*b*. As noted above, the sections 16, 18 may assume a superposed relationship by either pivoting one section 16 or 18 relative to the other hingedly connected section 18 or 16 as represented in FIGS. 3 and 3A, or by placing one separated section 16 or 18 on top of the other inverted section 18 or 16 so that their respective flanged undersides mate against each other.

In the preferred embodiment, the interlocking structure is formed on each of the ends 36*a*, 36*b* by a tab and notch arrangement. Specifically, opposed ends 36*a*, 36*b* of section 18 have outwardly projecting tabs 42 extending from the plane of the flanges 32. As best seen in FIG. 5, each tab 42 has sidewalls 44 that diverge outwardly from a linear terminal edge 46 extending across the width of the respective section 16 or 18. The sidewall 44 curves gradually inwardly and merges into a linear end wall 48 so as to form a pair of spaced apart, wing portions 50. Opposed ends 36*a*, 36*b* of adjacent sections 16 are formed with inwardly directed notches 52 defined by a linear back wall 54 that connects outwardly converging sidewalls 56. The sidewalls 56 curve outwardly and merge into a terminal edge 58 to form winged portions 60. It should be appreciated that due to the nature of the plastic material used in forming the sections 16, 18, the winged portions 50, 60 have a resiliency which will provide an interlocking capability. That is, the winged portions 50 of the tabs 42 are designed to frictionally overlap and engage the winged portions 60 of notches 52 to positively hold the superposed sections 16, 18 together.

In using the roll support and spacing structure 10 to form a multi-roll stack such as shown in FIG. 1, the connected sections 16, 18 of FIG. 2 are pivoted repeatedly along hinge 20 to break them apart into independent members. When separated, the sections 16, 18 may be placed on the bottom of a pallet 14 with the indentations 22 facing upwardly to support a lower roll layer 12*b*. Once the lower roll member 12*b* is supported, the connected sections 16, 18 of a structure 10 are placed in superposed relationship and interconnected together so that their downwardly facing indentations 22 will engage the upper portion of the rolls 12 in lower layer 12*b* and the upwardly facing indentations 22 will be ready to support the upper roll layer 12*a*.

Figure 6:
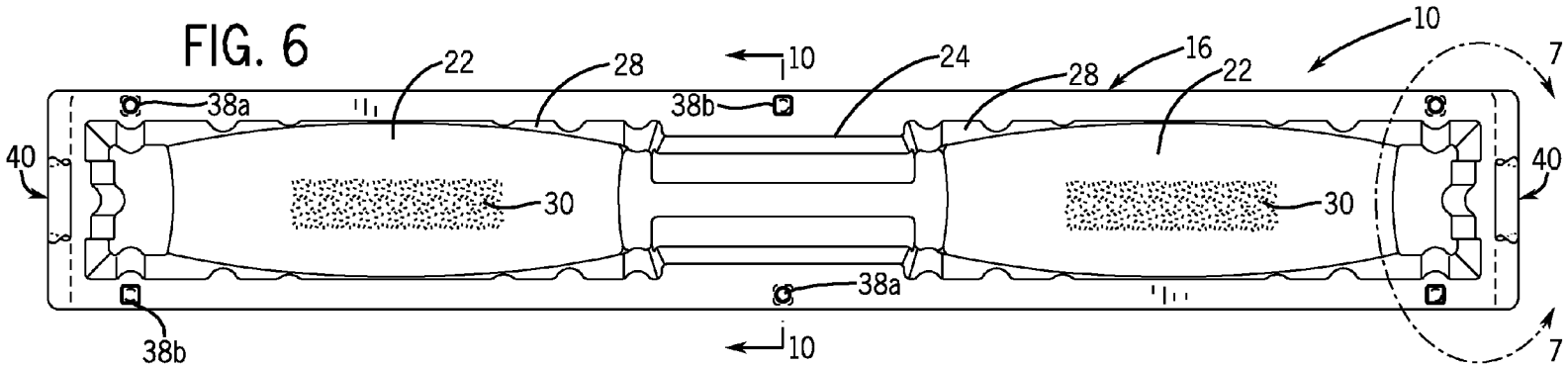
FIG. 6 is a top view of the section shown in FIG. 5 in superposed relationship and interconnected together.
Figure 7:
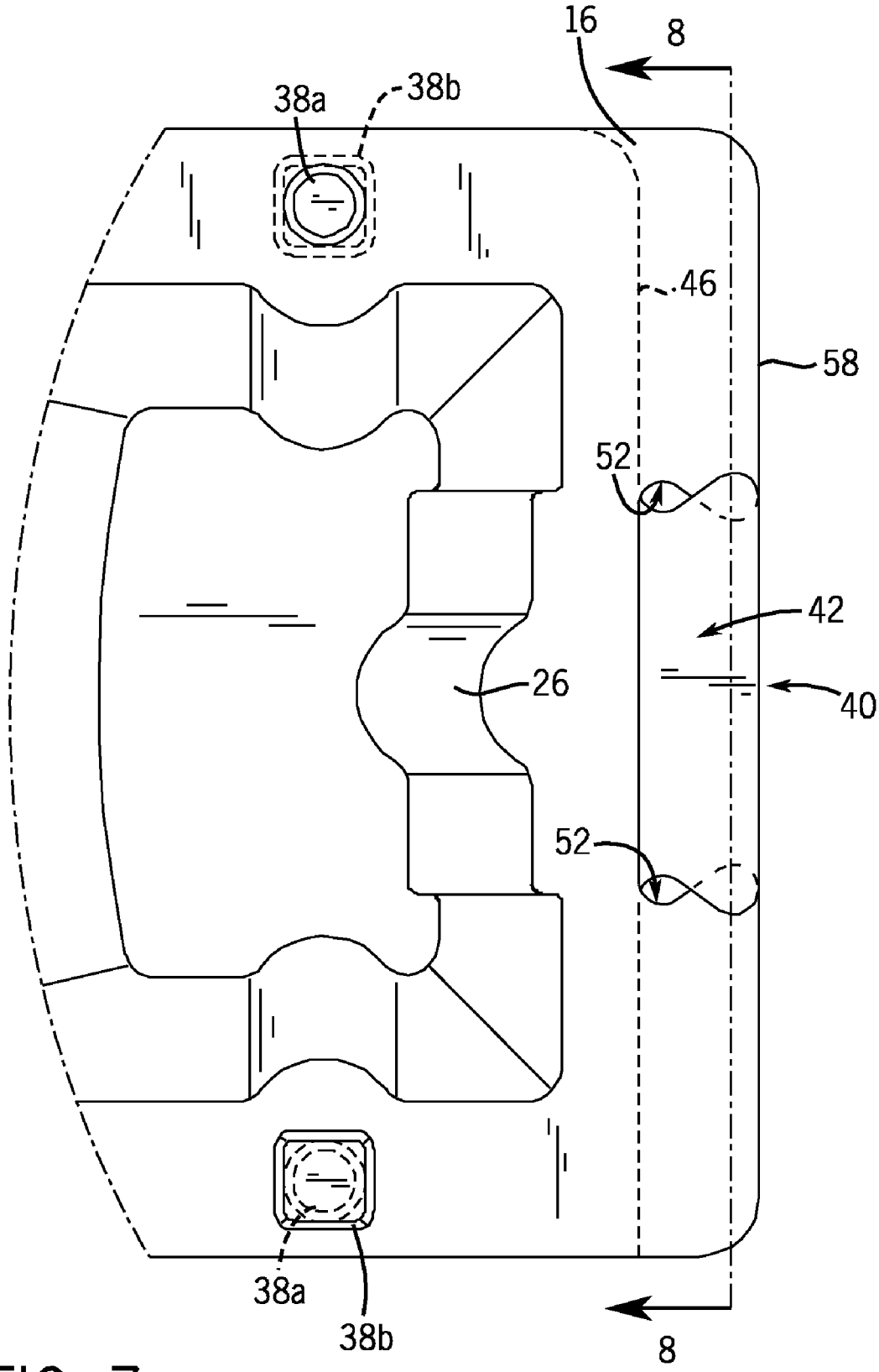
FIG. 7 is an enlarged detailed view taken on line 7-7 of FIG. 6.
Figure 8:
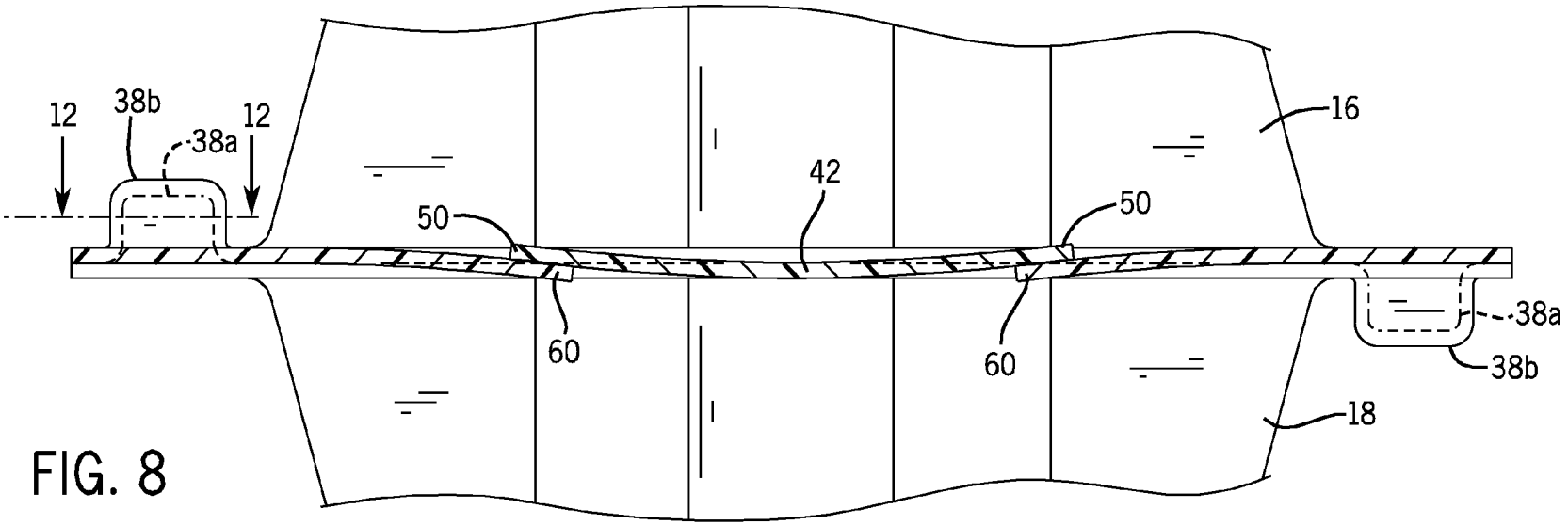
FIG. 8 is a sectional view taken on line 8-8 in FIG. 7.

The sections 16, 18 may be placed in superposed relationship in either of two ways. In a first method, the sections 16, 18 are hingedly connected as shown in FIG. 2, and then are pivoted one beneath the other as depicted in FIGS. 3 and 3A. Here, the section 16 is pivoted beneath section 18 so that the bosses 38 on the sections 16, 18 will provide alignment therebetween. To positively lock the sections 16, 18 together, the winged portions 50 of the tabs 42 on section 18 are snapped beneath the winged portions 60 of the notches 52. In a second method, the sections 16, 18, may be placed in superposed relationship by repeatedly folding the sections 16, 18 along hinge 20 breaking them into separate pieces as shown in FIG. 4. Then, the sections 16, 18 may be placed one on top of the other and interconnected with the interlocking structure 40 as described above. FIG. 6-8 show a reverse orientation wherein section 16 is on top of section 18. FIG. 8 shows that in the interlocked position, the tab 42 bows slightly with its winged portions 50 pushing down slightly on winged portion 60 of the formed recess 52. Bosses 38*a*, 38*b* help maintain the alignment of the sections 16, 18. The alignment and the interlocking of the sections 16, 18 ensures that there will be proper roll support and spacing between layers of multi-stack rolls 12. To finish building the stack, sections 16, 18 are placed with indentations 22 facing downwardly on the top ends of the upper roll layer 12*a*. When the stack is completely built, it may be encased in a suitable plastic film 15 or otherwise secured by straps or the like.

It should be understood that the invention contemplates further or alternative interlocking structure 40 that could be located on other portions of the sections 16, 18 such as on their opposed sides 34*a*, 34*b*.

While the invention has been described with reference to a preferred embodiment, those skilled in the art will appreciate that certain substitutions, alterations and omissions may be made without departing from the spirit thereof. Accordingly, the foregoing description is meant to be exemplary only and should not be deemed limitative on the scope of the invention set forth with the following claims.

We claim:

1. In a roll support and spacing member having parallel, connected, nestable first and second sections foldable upon a hinge to provide support structure in the middle of a stack of rolls and having upwardly and downwardly facing, roll engaging indentations with the sections being selectively separable to provide top and bottom support pieces for engaging rolls in the stack, the sections being movable into superposed relationship with one another, the improvement wherein:

the first section having a peripheral flange extending along a first common plane and the second sections having a peripheral flanges extending along a second common plane, wherein the peripheral flanges are each located along opposed sides and opposed ends thereof and formed with cooperable, interlocking structure selectively engagable for positively retaining the sections together when the sections are placed in superposed relationship, wherein the interlocking structure is formed as a tab and notch arrangement formed entirely within the first and second common planes, wherein the first and second common planes are parallel to each other and the tab and notch arrangement is selectively engagable and disengagable while the sections are in the superposed relationship such that the tab and notch arrangement prevents separation of the first and second sections from the superposed relationship when engaged.

2. The improvement of claim 1 wherein the tab and notch arrangements are provided on the opposite end of the sections.

3. The improvement of claim 1 wherein the first and second sections are separable from each other along the hinge.

4. A roll support and spacing member comprising:

a first section having a pair of spaced end walls, a pair of spaced side walls, a pair of roll receiving indentations and a peripheral flange extending from the pair of end walls and the pair of side walls along a first common plane;

a second section having a pair of spaced end walls, a pair of spaced side walls, a pair of roll receiving indentations and a peripheral flange extending from the pair of end walls and pair of side walls along a first common plane;

a tab formed entirely within the first common plane of the peripheral flange of the first section; and a notch formed entirely within the first common plane of the peripheral flange of the second section, wherein when the first and second sections are positioned in a superposed position, the notch is selectively engagable and disengagable with the tab, wherein when the tab is engaged with the notch, the tab and notch positively retain the first and second sections in the superposed position and prevent separation of the first and second sections.

5. The roll support of claim 4 wherein the first and second sections are foldably interconnected along a hinge formed between the peripheral flange of the first section and the peripheral flange of the second section.

6. The roll support of claim 5 wherein the notch and tab are formed on opposite sides of the hinge.

7. A roll support and spacing member comprising:

a first section having a pair of spaced end walls, a pair of spaced side walls, a pair of roll receiving indentations and a peripheral flange extending from the pair of end walls and the pair of side walls along a first common plane;

a second section having a pair of spaced end walls, a pair of spaced side walls, a pair of roll receiving indentations and a peripheral flange extending from the pair of end walls and pair of side walls along a second common plane;

a first interlocking structure formed entirely within the first common plane including the peripheral flange of the first section; and a second interlocking structure formed entirely within the first common plane including the peripheral flange of the second section, wherein when the first and second sections are positioned in a superposed position, the first interlocking structure is selectively engagable and disengagable with the second interlocking structure such that when the first and second interlocking structures are engaged, the first and second interlocking structures positively retain the first and second sections in the superposed position and prevent separation of the first and second sections.

8. The roll support of claim 7 wherein the first and second sections are foldably interconnected along a hinge formed between the peripheral flange of the first section and the peripheral flange of the second section.

* * * * *